US008448673B2

(12) United States Patent
Danaczko et al.

(10) Patent No.: US 8,448,673 B2
(45) Date of Patent: May 28, 2013

(54) TRANSPORTING AND TRANSFERRING FLUID

(75) Inventors: Mark A. Danaczko, Houston, TX (US); Mark C. Gentry, The Woodlands, TX (US); Robert E. Sandstrom, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 805 days.

(21) Appl. No.: 12/447,635

(22) PCT Filed: Sep. 17, 2007

(86) PCT No.: PCT/US2007/020107

§ 371 (c)(1),
(2), (4) Date: Jan. 15, 2010

(87) PCT Pub. No.: WO2008/060350

PCT Pub. Date: May 22, 2008

(65) Prior Publication Data

US 2010/0108145 A1 May 6, 2010

Related U.S. Application Data

(60) Provisional application No. 60/859,266, filed on Nov. 15, 2006.

(51) Int. Cl.
*B65B 3/04* (2006.01)
*B63B 27/30* (2006.01)

(52) U.S. Cl.
USPC ..... 141/1; 141/11; 62/50.2; 62/53.2; 62/606; 137/889.2; 441/4

(58) Field of Classification Search
USPC ..... 141/1, 4, 11; 441/4; 62/50.2, 53.2, 62/606, 611
See application file for complete search history.

(56) References Cited

U.S. PATENT DOCUMENTS 3,590,407 A 7/1971 Bratianu
4,846,780 A 7/1989 Galloway et al.

(Continued)

FOREIGN PATENT DOCUMENTS

EP 0 119 384 A1 9/1984
EP 1 383 676 B1 1/2004

(Continued)

OTHER PUBLICATIONS

Han, Hans Y. S. et al., "Design Development of FSRU from LNG Carrier and FPSO Construction Experiences", OTC 14098, 2002 Offshore Technology Conference, May 6-9, 2002, 8 pages, Houston, TX.

(Continued)

*Primary Examiner* — Timothy L Maust
*Assistant Examiner* — Timothy Kelly
(74) *Attorney, Agent, or Firm* — ExxonMobil Upstream Research Company-Law Department

(57) ABSTRACT

A method and system for transporting fluid is described. The method includes coupling a transit vessel to a terminal vessel associated with at least one terminal. The transit vessel and the terminal vessel are coupled at an open sea or lightering location, which may be selected based upon operational conditions. Then, cryogenic fluid is transferred between the transit vessel and the terminal vessel, while the transit vessel and terminal vessel are moving in substantially the same direction. Once the transfer is complete, the terminal vessel decouples from the transit vessel and moves a terminal to provide the cryogenic fluid to the terminal. The cryogenic fluid may include liquefied natural gas (LNG) and/or liquefied carbon dioxide ($CO_2$).

30 Claims, 7 Drawing Sheets

U.S. PATENT DOCUMENTS

| | | | | |
|---|---|---|---|---|
| 5,293,751 | A * | 3/1994 | Asai | 62/53.1 |
| 5,501,625 | A | 3/1996 | Belinsky | |
| 5,549,164 | A | 8/1996 | Blandford | |
| 6,003,603 | A | 12/1999 | Breivik et al. | |
| 6,089,022 | A | 7/2000 | Zednik et al. | |
| 6,637,479 | B1 | 10/2003 | Eide et al. | |
| 6,923,225 | B2 | 8/2005 | Poldervaart et al. | |
| 7,073,457 | B2 | 7/2006 | Boatman | |
| 7,080,673 | B2 | 7/2006 | Pollack et al. | |
| 7,117,808 | B2 * | 10/2006 | Kulikov et al. | 114/230.1 |
| 7,147,021 | B2 | 12/2006 | Dupont et al. | |
| 7,174,931 | B2 | 2/2007 | Espinasse | |
| 2002/0174662 | A1 | 11/2002 | Frimm et al. | |
| 2004/0187385 | A1 | 9/2004 | Perkins et al. | |
| 2005/0193938 | A1 | 9/2005 | Boatman et al. | |
| 2006/0010911 | A1 | 1/2006 | Hubbard et al. | |
| 2006/0156744 | A1 | 7/2006 | Cusiter et al. | |
| 2006/0180231 | A1 | 8/2006 | Harland et al. | |
| 2006/0231155 | A1 | 10/2006 | Harland et al. | |
| 2007/0074786 | A1 | 4/2007 | Adkins et al. | |
| 2007/0163481 | A1 | 7/2007 | Vedeld et al. | |
| 2008/0127673 | A1 * | 6/2008 | Bowen et al. | 62/611 |
| 2009/0199575 | A1 * | 8/2009 | Faka | 62/50.1 |
| 2009/0272126 | A1 * | 11/2009 | Mathews et al. | 62/50.2 |
| 2010/0000252 | A1 * | 1/2010 | Morris et al. | 62/611 |

FOREIGN PATENT DOCUMENTS

| | | | |
|---|---|---|---|
| WO | WO 01/03793 | A1 | 1/2001 |
| WO | WO 2006/044053 | A1 | 4/2006 |
| WO | WO 2006/088371 | A1 | 8/2006 |

OTHER PUBLICATIONS

Harland, Leon et al., "The Application of the FSRU for LNG Imports", Annual GPA Europe Chapter Meeting, Sep. 25-26, 2003, 19 pages.

Larsen, O. B. et al., "SRV—the LNG Shuttle and Regas Vessel System", OTC 16580, Offshore Technology Conference, May 3-6, 2004, 4 pages, Houston, TX.

Loez, Bernard, "New Technical and Economic Aspects of LNG Terminals", Petrole Information, Aug. 1987, p. 85-86.

Wayne, W. S., et al., "Modification of LNG Carriers for Regasification", OTC 15230, 2003 Offshore Technology Conference, May 5-8, 2003, 7 pages, Houston, TX.

Excelerate Energy, LLC. website www.excelerateenergy.com, Oct. 24, 2006, 2 pages.

European Search Report No. 115310 for 2006EM178, Jul. 13, 2007, 3 pages.

* cited by examiner

TRANSPORTING AND TRANSFERRING FLUID

CROSS REFERENCE TO RELATED APPLICATIONS

This application is the National Stage of International Application No. PCT/US07/20107, filed 17 Sep. 2007, which claims the benefit of U.S. Provisional Application No. 60/859,266, filed 15 Nov. 2006.

FIELD OF THE INVENTION

This invention relates generally to a method of transferring fluids. In particular, the method and system relate to a method of delivering cargo, such as liquefied natural gas (LNG) or liquefied carbon dioxide ($CO_2$), via vessels to an import terminal and/or exporting cargo from an export terminal in various markets throughout the world.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Cargo is generally transferred from one port location to another port location by vessels, such as carriers. These carriers have propulsion and navigation systems for movement across large bodies of water, which may be referred to as open seas. In addition, the carriers may include accommodations for marine operations and storage tanks for liquid cargo. For example, with some carriers, special equipment and systems may be installed to assist with the transport of specific cargo, such as LNG. As such, the systems on carriers provide a mechanism for economically transferring cargo between market locations.

As an example, after natural gas is produced from a well, it is processed and may be liquefied at export terminals or other facilities to convert it into liquefied natural gas (LNG). LNG is the basis of a delivery technology that allows remote natural gas resources to be economically delivered to other markets. The LNG is shipped to market in specially-designed LNG carriers (LNGC) that are configured to store and transport the LNG across the large bodies of water. Then, the LNG is converted back from LNG to natural gas at an import terminal near the market locations. Typically, the import terminals are located onshore at a port location or offshore near a port location. Regardless, the import terminal is connected through a pipeline to onshore equipment for further processing or distribution.

Offshore terminals may be beneficial because the terminals do not utilize onshore property and in an offshore environment, security concerns may be reduced. One concept for an offshore terminal is a floating storage and regasification unit (FSRU). FSRU is a dedicated, moored offshore structure that transfers cryogenic LNG with LNGCs, stores the LNG in storage tanks, regasifies the LNG using heat exchangers, and delivers the natural gas to a pipeline coupled to the import terminal. The FSRU concept generally includes cryogenic cargo transfer equipment and LNG vaporization facilities, which may be located on the platform of the FSRU.

However, offshore environmental conditions may be a factor that limit the time periods that the LNGCs and FSRUs can operate. For instance, harsh environmental conditions may provide periods of time where connecting the LNGCs and FSRUs cannot be done safely and reliably. Further, if the offshore environmental conditions are too severe to allow the LNGCs and FSRUs to remain connected, then the FSRUs can only deliver natural gas to the pipeline from its stored reserves. Further, if the stored reserves on the FSRUs are depleted, then natural gas delivery is stopped to the pipeline. Intermittent service or interruptions to the flow of natural gas into or from a pipeline may result in penalties and cost increases to terminal operators.

To address the environmental conditions, various offloading approaches are utilized to transfer LNG between LNGCs and FSRUs. For instance, one offloading approach is side-by-side offloading which is currently employed at land-based import and export terminals. Side-by-side offloading is performed with the LNGC and FSRU arranged in a side-by-side configuration with the LNG transfer occurring between conventional mechanical loading arms located near amidships of the FSRU and an offloading manifold on the LNGC. Because of the limitations on the movement of these loading arms and the relative motions between the LNGC and the FSRU, conventional land-based cargo transfer using mechanical loading arms is typically performed in protected waters with the significant wave height less than or equal to 1.5 meters.

A second offloading approach is tandem offloading. Tandem offloading is based on existing technology used to transfer oil between floating production storage and offloading (FPSO) vessels and shuttle tankers. In tandem offloading, the two vessels are arranged bow-to-stern, and the LNG transfer is achieved using flexible hoses or mechanical devices like pantographs. For LNGCs, the flexible cryogenic hoses or large loading arms, which are called booms, are utilized to transfer the cryogenic LNG with the LNGC carrier's bow located behind the stern of the FSRU. With the flexible cryogenic hoses, the tandem offloading approach may remain operable in more severe seastates, such as 2.5 to 3 meter significant waves, than the side-by-side offloading approach.

A third offloading approach is subsea LNG transfer system (SLTS) offloading approach, which is referenced in International Patent Application No. WO2006/044053. In the SLTS offloading approach, the LNGCs and FSRU are connected over a distance of about 2 kilometers (km) by subsea cryogenic risers and pipelines. The LNGC is connected to a floating cryogenic buoy and transfers the LNG through the buoy and one or more flexible cryogenic risers and pipelines to another buoy located at the FSRU. Because the LNGCs and FSRU are separated and may move independently, the SLTS may operate for more severe seastates, such as 4 to 5 meter significant waves. Accordingly, each of these offloading approaches may be utilized to maintain uniform delivery of NG to the pipeline, which is often part of gas marketing contracts.

However, the use of FSRUs with any of these offloading approaches suffers from technical and commercial limitations. For instance, because the FSRUs are permanently moored with no access to dry dock maintenance, a large infrastructure and associated capital expenditure is typically involved with any permanently-moored FSRU. This large initial capital expenditure results in a significant reduction in the overall LNG delivery chain economics. Also, additional equipment and operations, such as dedicated positioning tugs or navigation systems on the LNGCs, are involved to facilitate berthing operations for the LNGCs with the FSRU. While improved relative to onshore terminals, FSRUs still pose a security threat and have to be managed to address the open access provided in an offshore setting. Further, for certain offloading approaches, such as the SLTS approach, each of the LNGCs have to be modified with a turret to accommodate the buoy leading to increased costs for the entire LNGC fleet.

An alternative to the FSRU-based import or export terminal is to include the regasification equipment on the LNGC. See U.S. Pat. No. 6,089,022. These vessels are LNGCs with extensive modifications to allow shipboard regasification of the LNG and offloading of the natural gas through a conventional natural gas offloading buoy into the pipeline. These carriers, which may be referred to as regasification LNGCs, are equipped with traditional LNGC offloading equipment (e.g. a manifold to accept loading arms) to interact with conventional LNGCs. Disadvantageously, the capital expenses of these regasification LNGCs may be significantly larger than traditional LNGCs because each regasification LNGC is modified with heat exchangers for regasification operations, a turret for offloading to the gas buoy, and reinforced cargo tanks to withstand sloshing loads. In addition, the storage of the regasification LNGCs is limited because the regasification facilities are configured within a vessel designed for efficient transit over long distances.

As such, a method or mechanism for enhancing delivery of cargo, such as NG and LNG, in an efficient manner is needed. In addition, this method or mechanism may avoid the problems associated with onshore terminals, offshore FSRUs, and/or the use of regasification LNCGs over long distances.

Other related material may be found in at least U.S. Pat. Nos. 3,590,407; 5,501,625; 5,549,164; 6,003,603; 6,089,022; 6,637,479; 6,923,225; 7,080,673; 6,546,739; U.S. Patent Application Publication No. 2004/0187385; U.S. Patent Application Publication No. 2006/0010911; European Patent Application No. 1,383,676; International Patent Application No. WO 01/03793; International Patent Application No. WO2006/044053; Loez, Bernard "New Technical and Economic Aspects of LNG Terminals," Petrole Information, pp. 85-86, August 1987; Hans Y. S. Han et al., "Design Development of FSRU from LNG Carrier and FPSO Construction Experiences," Offshore Technology Conference May 6-9, 2002, OTC-14098; "The Application of the FSRU for LNG Imports," Annual GAP Europe Chapter Meeting September 25-26, 2003; O. B. Larsen et al., "The LNG (Liquefied Natural Gas) Shuttle and Regas Vessel System," Offshore Technology Conference May 3-6, 2004, OTC-16580; and Excelerate Energy (visited on Oct. 24, 2006) <http://www.excelerateenergy.com/activities.php>.

SUMMARY

In one embodiment, a method for transporting cryogenic fluid is described. The method comprises coupling a transit vessel to a terminal vessel at an open sea location; transferring cryogenic fluid between the transit vessel and the terminal vessel, wherein the cryogenic fluid is transferred while the transit vessel and terminal vessel are moving in substantially the same direction; decoupling the terminal vessel from the transit vessel; and moving the terminal vessel to a terminal to transfer the one of the cryogenic fluid and a gas formed from the cryogenic fluid between the terminal vessel and the terminal.

In another embodiment, a method for transporting fluid is described. The method comprises coupling a transit vessel to a first terminal vessel at an open sea location; transferring cryogenic fluid between the first terminal vessel and the transit vessel, wherein the cryogenic fluid is transferred while the transit vessel and first terminal vessel are moving in substantially the same direction; and decoupling the first terminal vessel from the transit vessel. The method may also comprise moving the transit vessel to another open sea location; coupling the transit vessel to a second terminal vessel at the another open sea location; transferring the cryogenic fluid between the second terminal vessel and the transit vessel, wherein the cryogenic fluid is transferred while the transit vessel and second terminal vessel are moving in a designated direction; and decoupling the second terminal vessel from the transit vessel. Also, the method may include moving the transit vessel to a terminal; coupling the transit vessel to the terminal; and transferring the cryogenic fluid between the transit vessel and a pipeline coupled to the terminal. Further, the method may comprise determining one of a plurality of terminals based on operational conditions; moving the transit vessel to the one of the plurality of terminals; coupling the transit vessel to the terminal; and transferring the cryogenic fluid between the transit vessel and a pipeline coupled to the terminal.

In yet another embodiment, a fluid transport system is described. The fluid transport system comprises at least one terminal; and a plurality of terminal vessels associated with the at least one terminal. The plurality of terminal vessels are configured to transfer cryogenic fluids with the at least one terminal; and transfer cryogenic fluids with one of a plurality of transit vessels, wherein the cryogenic fluids are transferred while one of the plurality of terminal vessels and the one of the plurality of transit vessels are moving in substantially the same direction. Each of the plurality of terminal vessels may be configured to communicate with the one of the plurality of transit vessels to provide an open sea location to couple with the terminal vessel based on operational conditions; and move the terminal vessel to the open sea location.

Further, in another embodiment, a method for transporting cryogenic fluids is described. The method comprising coupling a transit vessel to a terminal vessel at an open sea location; transferring cryogenic fluid between the transit vessel and the terminal vessel, wherein the cryogenic fluid is transferred while the transit vessel and terminal vessel are moving in substantially the same direction; decoupling the terminal vessel from the transit vessel; selecting one of a plurality of terminals based on at least one operational condition; and moving the terminal vessel to the one of the plurality of terminals to transfer the cryogenic fluid between the terminal vessel and the one of the plurality of terminals.

In another embodiment, another method for transporting fluid is described. The method comprises coupling a transit vessel to a terminal vessel at an open sea location, wherein the terminal vessel is one of an ice breaker carrier or an ice strengthened carrier; transferring fluid between the transit vessel and the terminal vessel, wherein the fluid is transferred while the transit vessel and terminal vessel are moving in substantially the same direction; decoupling the terminal vessel from the transit vessel; and moving the terminal vessel through ice packs to reach a terminal to transfer the one of the fluid and a gas formed from the fluid between the terminal vessel and the terminal.

In each of the embodiments, the cryogenic fluid may include liquefied natural gas (LNG) and/or liquefied carbon dioxide ($CO_2$). Accordingly, other alternative embodiments may include different equipment in the terminals or terminal vessels, which may be associated with the cryogenic fluid or transfer operations. For instance, the terminal may comprise one or more submerged turret loading buoys; may be secured to the seafloor and coupled to a pipeline that provides fluids to onshore equipment; may comprise at least one of living quarters, maintenance facilities, safety systems, emergency escape and evacuation systems, logistics systems and power generation; and may comprise two or more berthing structures, which are one of berthing dolphins fixed to the seafloor, a spread mooring system, submerged turret loading buoys, and any combination thereof. Also, the terminal vessels may comprise cryogenic loading arms to transfer the LNG; cryogenic hoses to transfer the LNG; an ice strengthened hull or ice breaker equipment; azimuthing thrusters; storage tanks for containing LNG, which are one of prismatic tanks, spherical tanks, membrane tanks, modular tanks and any combination thereof, and facilities for vaporizing the LNG.

Further, other alternative embodiments may include other features. For instance, the methods may further comprise regasifying the LNG on the terminal vessel and delivering the regasified LNG to a pipeline coupled to the terminal; delivering the LNG to the terminal and vaporizing the LNG at the terminal for delivery of the vaporized LNG to a pipeline coupled to the terminal; receiving natural gas from a pipeline at the terminal and liquefying the natural gas to form LNG on the terminal vessel; receiving LNG from the terminal; wherein transferring fluid between the transit vessel and the terminal vessel comprises one of side-by-side offloading and tandem offloading; moving the terminal vessel through ice packs to reach the terminal. Further, the methods may comprise coupling another terminal vessel to the terminal; and transferring additional cryogenic fluid between the another terminal vessel and the terminal concurrently with transferring the cryogenic fluid between the transit vessel and the terminal vessel. Also, the methods may comprise selecting the open sea location based upon at least one operational condition, such as an environmental condition (e.g. weather, seastates, and any combination thereof) or commercial condition (e.g. locations relative to best market, contractual obligations).

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description section, the specific embodiments of the present techniques are described in connection with preferred embodiments. However, to the extent that the following description is specific to a particular embodiment or a particular use of the present techniques, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The present techniques are directed to a method and system for transport of cargo, such as liquefied natural gas (LNG) or other cryogenic liquefied gases, via vessels between an export location and an import location. Under the present techniques, terminal vessels are utilized to transfer cargo, such as LNG or liquefied $CO_2$, with a terminal, such as an import terminal, for example. Then, the terminal vessels transfer cargo with transit vessels in the open sea, while the vessels are moving in the same direction or coupled together in some manner. Once the transfer is complete, the terminal vessel moves to the offloading buoy to offload the cargo, while the transit vessels move to another location, such as an export terminal, to receive another cargo. Further, the terminal vessels may include vessels with ice breaking capabilities, regasification facilities, or other specific features that may enhance the transfer operations for a specific terminal. Accordingly, the present techniques may enhance delivery of cargo from one location to another location.

Cryogenic fluids may include liquefied natural gas, liquefied $CO_2$, and other liquefied gases. The cryogenic fluids may be liquefied gases that are maintained at low temperatures to remain in a liquid phase. For example, typical storage conditions for LNG may include pressures at about 1 atmosphere (atm) and temperatures in a range from about −163° C. to about −150° C. Also, typical storage conditions for $CO_2$ may include conditions, such as the pressures at about 20 bars and the temperatures at about −40° C.

Figure 1:
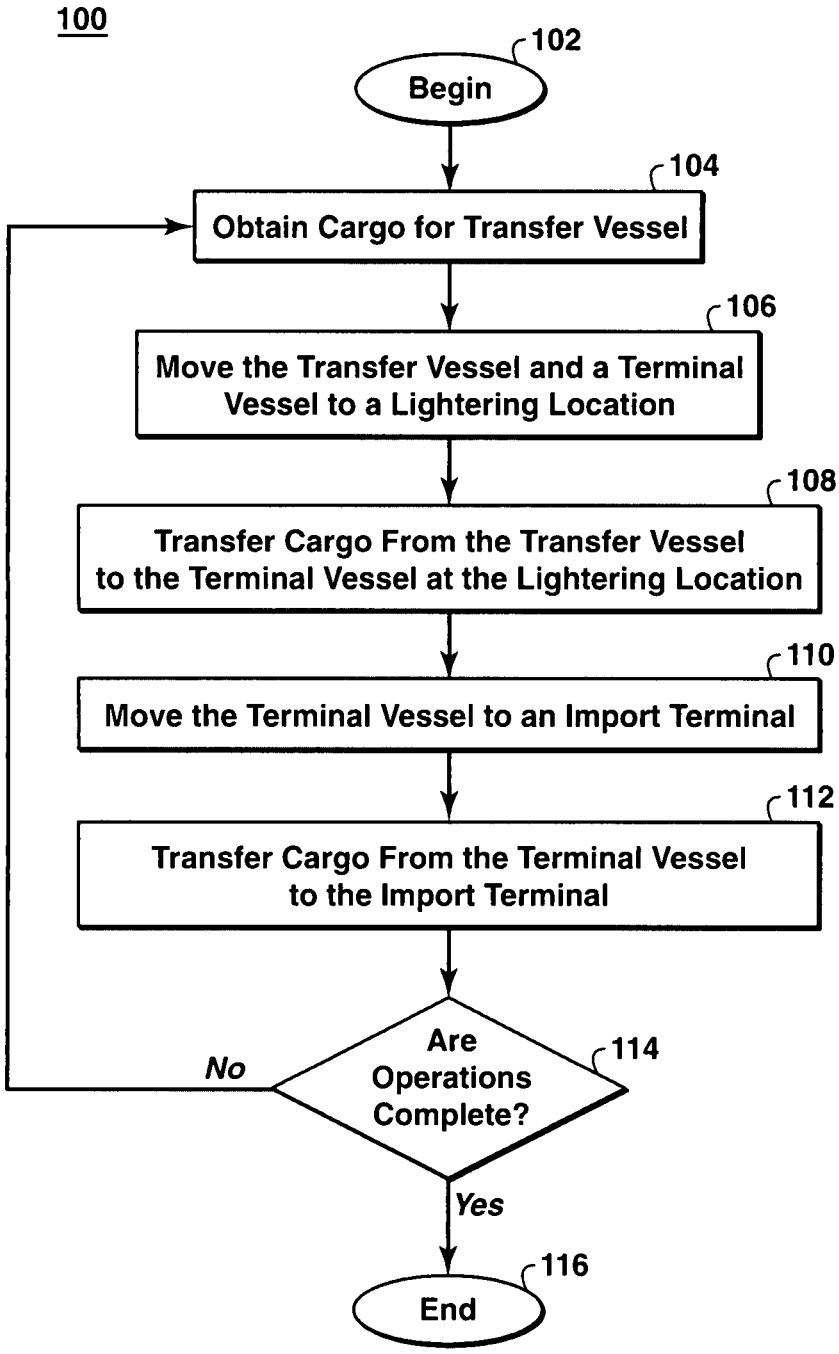
FIG. 1 is an exemplary flow chart of the fluid transfer operations in accordance with certain aspects of the present techniques.

Turning now to the drawings, and referring initially to FIG. 1, an exemplary flow chart of the fluid transfer operations in accordance with certain aspects of the present techniques is illustrated. In the exemplary flow chart, which may be referred to by reference numeral 100, various operations may be performed to transfer cargo, such as liquefied natural gas (LNG), natural gas (NG), or other suitable cargo, from a lightering location to an import terminal. The transfer operations include the use of transit vessels and terminal vessels with the terminal vessels transferring the cargo between a lightering location and an import terminal. The transfer operations of these vessels are discussed further below.

The flow chart begins at block 102. At block 104, cargo, such as NG or LNG, is obtained by a transit vessel. The cargo may be obtained at an export terminal, such as a land based LNG plant, an onshore LNG or NG terminal, an offshore LNG or NG terminal, other liquefied gas terminal and the like. The transit vessel may be a LNGC or other suitable vessel that is configured to operate in an open sea environment. The open sea or open sea environment refers to any division of a large body of water, which may include bays, lakes, seas, oceans, gulfs or the like. The open sea may include territorial waters or international waters as well. Once the cargo is obtained, the transit vessel and a terminal vessel move to a lightering or open sea location, as shown in block 106. The lightering location, which is near an import terminal, is a location that the terminal vessel and the transit vessel meet to form fluid communication paths between the vessels. This lightering location may be determined based on a lightering loop that is a function the speed of the terminal vessels and the transfer rate of the fluid (e.g. cryogenic fluid or regasified fluid) between the terminal vessel and terminal or transit vessel. As such, the lightering location may have a maximum distance that is limited by the distance calculated for the lightering loop. The terminal vessel may include vessels, such as LNG carriers (LNGCs), LNGCs having storage tanks and regasification facilities (e.g. regasification LNGCs), NG or LNG carriers configured to break through ice packs, and the like, which are discussed further below. At block 108, the transit vessel transfers cargo to the terminal vessel. The transfer operations may include different offloading approaches, such as side-by-side offloading, tandem offloading, or subsea LNG transfer system (SLTS) offloading, for example. These transfer operations may be performed by meeting at the lightering location and transferring cargo while the transit vessel and terminal vessel are moving in substantially the same direction. In particular, the vessels may move at about 10 knots during the transfer operations in a direction that does not exceed the lightering loop or lightering range.

Then, the terminal vessel moves to the import terminal, as shown in block 110. The import terminal may be a land based LNG plant, an onshore LNG or NG terminal, an offshore LNG or NG terminal, an LNG terminal and the like. At block 112, the cargo is transferred from the terminal vessel to the import terminal. The transfer may be similar to the transfers discussed above. At block 114, a determination is made about whether operations are complete. If the operations are not complete, the process may continue at block 104. The continued operation may include the transit vessels and terminal vessels repeating the process described above. However, if the operations are complete, the process may end at block 116.

Beneficially, the use of the present techniques may enhance the transfer of cargo, such as $CO_2$. LNG or other liquefied gas, over other techniques from a commercial perspective. For instance, the present techniques limit the permanent equipment installed at the import terminal. That is, the import equipment at the import terminal may include offloading buoys and connections to one or more pipelines, which reduce the infrastructure and capital cost for installing an import terminal. Further, the only permanent equipment at the import terminal may be the submerged gas offloading buoy. With this limited amount of equipment, permitting may be easier, and public support for the import terminal may be increased. Also, because the cargo transfer may occur outside of closed areas, such as a harbor or port, the security concerns for the transfer operations may be reduced in comparison to near shore cargo transfer operations. Further, with this type of configuration, the cargo transfer between vessels is not stationary at a single location, but may be performed at any of a variety of locations in an open sea environment. This movement may provide problems for those attempting to interrupt or disrupt the cargo transfer process.

In addition, the offloading equipment may be any conventional type of equipment used for the transfer of the cargo if the terminal vessels are utilized to process the cargo before delivery to the import terminal or pipeline. For instance, if the offloading equipment is utilized to transfer LNG between the terminal vessel and the transit vessel, conventional LNGC manifolds may be utilized without having to modify LNGCs. Thus, the cargo transfer process does not involve modifications to the transit vessels, but may be compatible with existing technologies to provide flexibility in receiving and marketing cargo.

Furthermore, the present techniques may reduce or limit potential interruptions due to environmental conditions. That is, because the transit and terminal vessels may exchange cargo at any open sea location, if high seastates are present, the lightering location may simply be moved to a location with more benign environmental conditions. This flexibility addresses one of the primary limitations of the side-by-side offloading or other fixed terminal offloading approaches, which are limited by wave heights for offloading operations. Further still, while the offloading operations from the terminal vessels to the import terminal is still subject to seastate limitations, the seastate limits for connecting and staying connected to a conventional natural gas buoy with non-cryogenic risers (e.g. STL buoy) are larger than the seastate limits for side-by-side, tandem and/or SLTS offloading.

Moreover, cargo transfers in the open sea may provide other enhancements to cargo transfer processes. For instance, the flexibility to move vessels to mild environmental conditions reduces partial fill sloshing loads of cargos, which may be experienced by the transit vessels. In particular, reducing this sloshing of LNG or other fluids may further reduce the costs of building the terminal vessels, such as regasification LNGCs, in comparison to other vessels. These other transit vessels have to address the sloshing problem for long distance transfers, which may not be present for terminal vessels in this process. Also, because the cargo transfer occurs in the open sea, positioning tugs and dynamic positioning systems may not be necessary, which provides other potential cost reductions for transfer operations.

Figure 2:
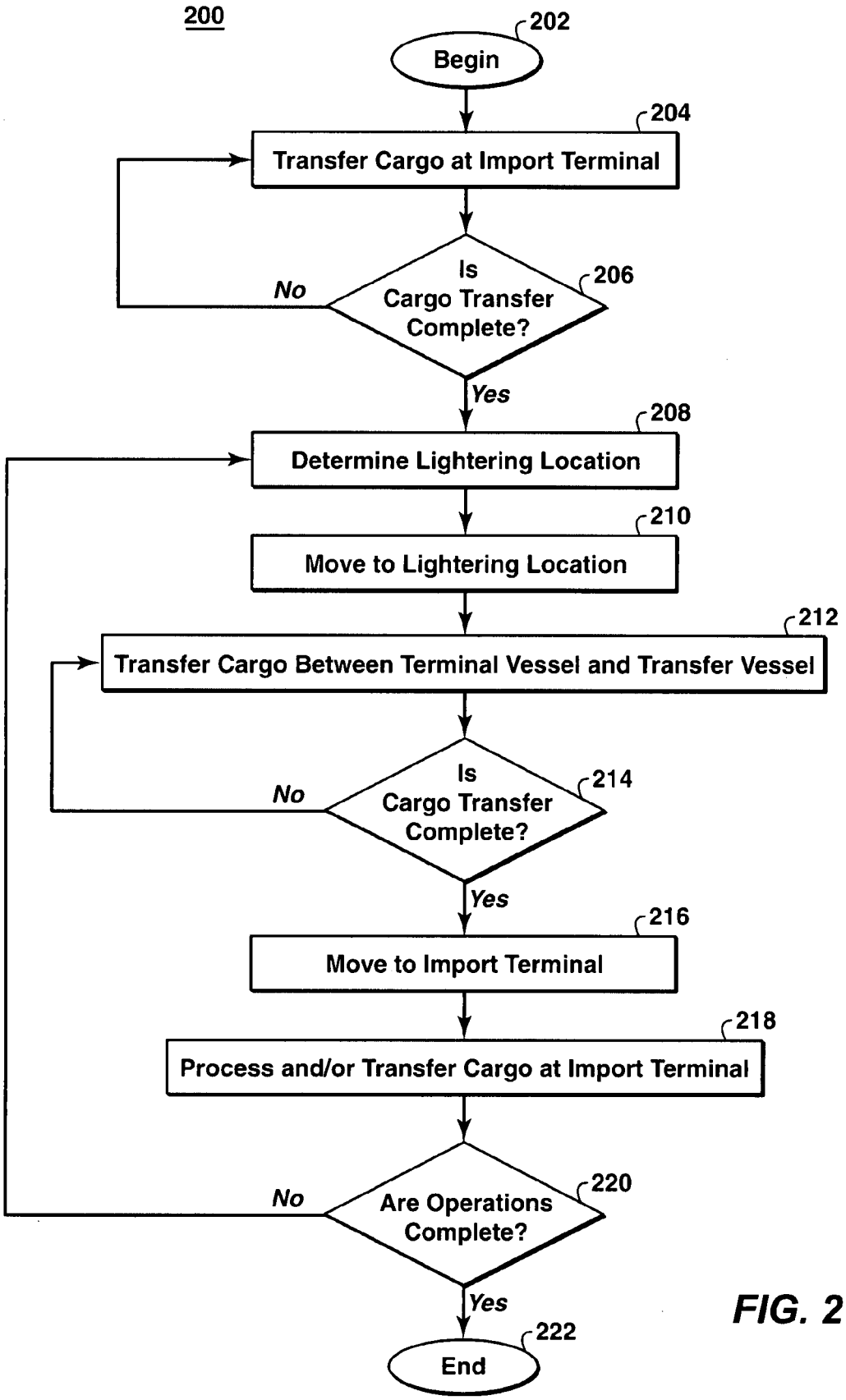
FIG. 2 is an exemplary flow chart of the transfer operations of FIG. 1 for a terminal vessel in accordance with certain aspects of the present techniques.

FIG. 2 is an exemplary flow chart of the transfer operations of FIG. 1 for a regasification LNGC in accordance with certain aspects of the present techniques. In the exemplary flow chart, which may be referred to by reference numeral 200, the transfer of cargo, such as LNG and/or NG, for a terminal vessel with a transit vessel and an import terminal is described. The terminal may include two or more Submerged Turret Loading (STL) offloading buoys, which may be fixed to the seafloor in an open sea environment to berth and offload cargo, such as LNG or NG. However, it should be appreciated that the terminal may be any suitable import or export terminal in other embodiments.

The flow chart begins at block 202. At block 204, the cargo, such as LNG or NG, is transferred at the import terminal. As discussed above, the transfer of cargo may include different offloading approaches. At block 206, a determination is made whether the cargo transfer is complete. If the cargo transfer is not complete, the transfer of cargo continues at block 204. However, if the cargo transfer is complete, a determination of a lightering location may be made in block 208. The lightering location may be selected based on operational conditions. The operational conditions may include favorable environmental conditions (e.g. weather, seastates, storms, etc.) and commercial conditions (e.g. locations relative to best market, contractual obligations, etc.). Regardless, the lightering location is identified for the terminal vessel and communicated to the transit vessel.

At block 210, the terminal vessel moves to the lightering location. The movement of the terminal vessel may be based on the determination of the lightering loop, as discussed above. Then, an exchange or transfer between the terminal vessel and the transit vessel is performed, as shown in block 212. The transfer may occur while the transit vessel and terminal vessel are moving in substantially the same direction along the surface of the open sea. Further, this transfer may occur at speeds along the surface of the open sea (e.g. body of water) for the terminal and transit vessels that are less than the transit vessels speed on the open sea. Because the terminal vessel is associated with an import terminal, the cargo is offloaded from the transit vessel to the terminal vessel. At block 214, a determination is made whether the cargo transfer is complete. If the cargo transfer is not complete, the transfer of cargo continues at block 212. However, if the cargo transfer is complete, the transit vessel moves to the import terminal, as shown in block 216.

At the import terminal, cargo is processed and transferred, as shown in block 218. The processing may include regasification of the cargo, compression of the regasified cargo, and/or other similar processing operations, while transferring may utilize any of the offloading approaches discussed above in block 204. At block 220, a determination is made whether the operations are complete. If the operations are not complete, then a determination is made about another lightering location, as shown in block 208. However, if the operations are complete, the process ends, as shown in block 222.

Figure 3:
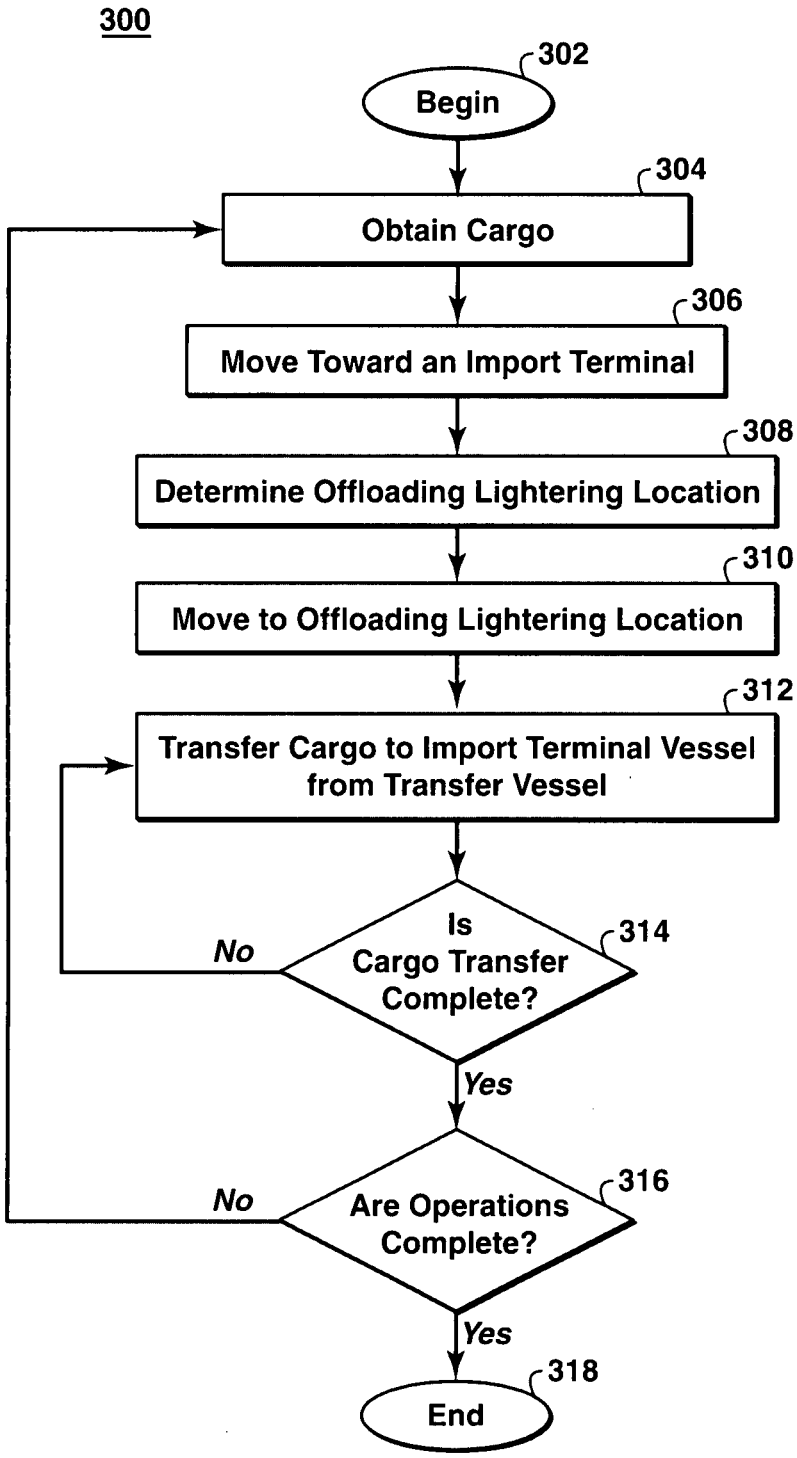
FIG. 3 is an exemplary flow chart of the transfer operations of FIG. 1 for a transit vessel in accordance with certain aspects of the present techniques.

For an alternative perspective, FIG. 3 is an exemplary flow chart of the transfer operations in FIG. 1 for a transit vessel in accordance with certain aspects of the present techniques. In the exemplary flow chart, which may be referred to by reference numeral 300, the transfer of cargo, such as LNG and/or NG, for a transit vessel is described. It should be appreciated that the transit vessel may transfer cargo with one of an export terminal or an import terminal with the other transfer being with a terminal vessel in other embodiments.

The flow chart begins at block 302. At block 304, cargo is obtained by the transit vessel. Obtaining the cargo may include receiving the cargo from an export terminal vessel at a receiving lightering location or receiving the cargo from an export terminal. As discussed above, obtaining the cargo may include different offloading approaches. Once obtained, the transit vessel moves toward the import terminal 306. The movement involves the transport of the cargo over the open sea environment.

At block 308, a determination of an offloading lightering location is made. The offloading lightering location may again be selected based on various conditions, as discussed above. Once an offloading lightering location is determined, the transit vessel may move to the offloading lightering location, as shown in block 310. Then, if the import terminal vessel is at the offloading lightering location, the cargo is transferred from the transit vessel to the import terminal vessel, as shown in block 312. As discussed above, the transfer of cargo may include different offloading approaches. At block 314, a determination is made whether the cargo transfer is complete. If the cargo transfer is not complete, the transfer of cargo continues at block 312. If the cargo transfer is complete, a determination is made whether the operations are complete, as shown in block 316. If the operations are not complete, then the transit vessel proceeds to obtain another cargo, as shown in block 304. However, if the operations are complete, the process ends, as shown in block 318. Examples of this method and the method of FIG. 2 are described below in the exemplary fluid transport systems or fleets of FIGS. 4-6.

Figure 4:
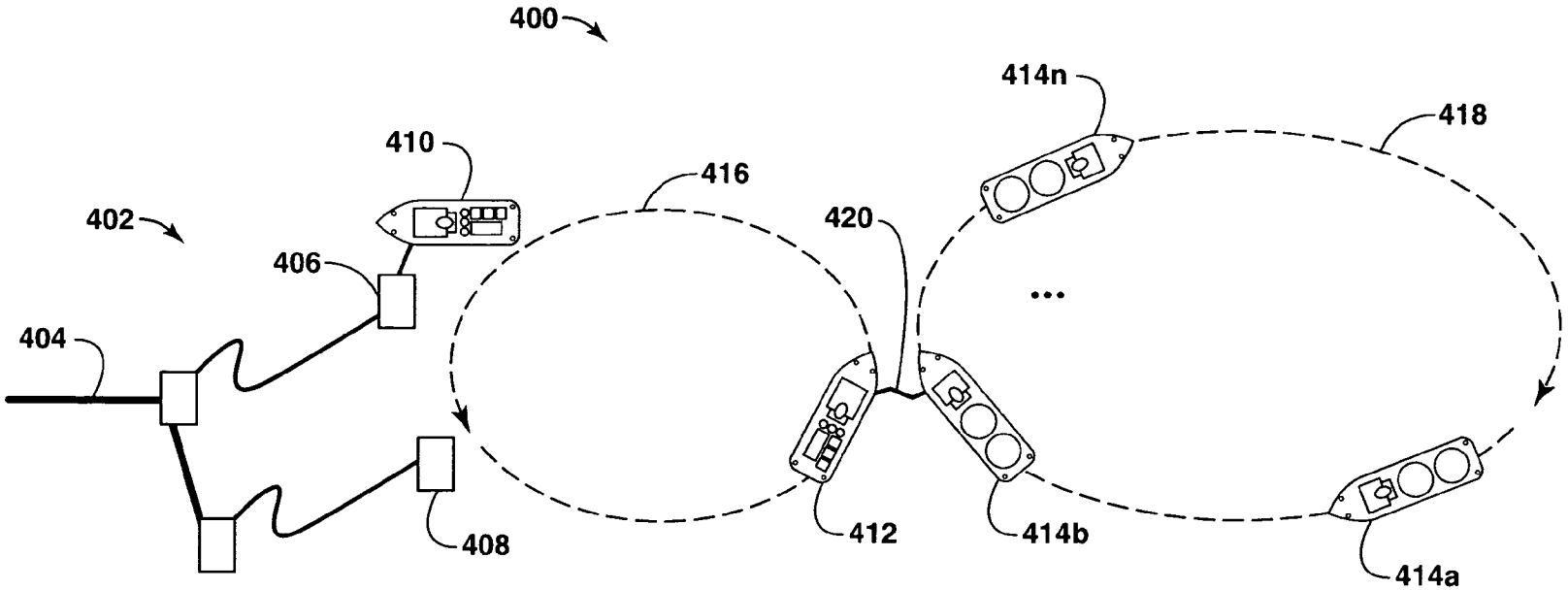
FIG. 4 is an illustration of an exemplary fluid transport system or fleet in accordance with certain aspects of the present techniques.

FIG. 4 is an exemplary fluid transport system or fleet 400 in accordance with certain aspects of the present techniques. In the exemplary fluid transport system 400, an import terminal 402 may be positioned at an open sea berth import location and coupled to a pipeline 404. The pipeline 404 may receive natural gas or vaporized LNG from terminal vessels (e.g. LNGCs functioning as a floating storage and regasification units (FSRUs), such as regasification LNGCs 410 and 412). The regasification LNGCs 410 and 412 may follow a lightering loop 416 to receive LNG from transit vessels, which may include one or more LNGCs that follow a transit loop 418, such as LNGCs 414*a*-414*n*. The number n of LNGCs 414*a*-414*n* may be any integer number. In this manner, LNG from an export terminal (not shown) may be transferred by LNGCs 414*a*-414*n* to regasification LNGCs 410 and 412 that convert LNG to natural gas for the import terminal 402. Beneficially, the import terminal 402 enhances cargo transfer operations over existing offshore terminals, while also reducing limitations of the existing terminal designs, which are discussed above.

The import terminal 402 may include various mechanisms to couple one or more regasification LNGCs 410 and 412 to the pipeline 404. For instance, the import terminal 402 may include two or more STL buoys, such as first STL buoy 406 and second STL buoy 408, which may be fixed to the seafloor in an open sea environment to berth and offload natural gas. The pipeline 404 (e.g. a natural gas pipeline) is configured to receive natural gas and transfer the natural gas to onshore facilities (not shown). The pipeline 404 may function at operating conditions of typical pipelines as is known in the art. For example, the operating conditions for gas pipeline may be up to pressures of about 80 bar for temperatures of 2° C. It should be noted that the import terminal 402 may also be a structure having one or more berthing structures fixed to the sea floor, a buoy system and/or other similar structures that may provide fluid communication with the pipeline 404.

To provide the LNG, the LNGCs 414*a*-414*n* and regasification LNGCs 410 and 412 follow the respective lightering loop 416 and transit loop 418. The regasification LNGCs 410 and 412 and LNGCs 414*a*-414*n* may be equipped with typical systems for propulsion and navigation along with accommodations for marine operations and storage tanks. The storage tanks may include various types of tank designs, such as membrane tanks, self-supporting prismatic (SPB), spherical and rectangular (modular) tanks, which are suitable for storing LNG. In addition, the regasification LNGCs 410 and 412 and LNGCs 414*a*-414*n* may include ancillary systems, such as living quarters and maintenance facilities, safety systems, emergency escape and evacuation systems, logistics systems, power generation and other utilities to support operations. While each of the regasification LNGCs 410 and 412 and LNGCs 414*a*-414*n* include LNG storage tanks and other typical equipment, the regasification LNGCs 410 and 412 may also include regasification equipment and offloading equipment. The regasification equipment may include any of a variety of conventional types of equipment that are used to convert LNG from the LNGC into its gaseous state in an onshore LNG import terminal, such as heat exchangers, pumps and compressors. The offloading equipment may include cryogenic loading arms, cryogenic hoses, STL buoys and other equipment utilized in the transfer of LNG. In particular, the cryogenic loading arms and cryogenic hoses may be designed to accommodate LNG carrier motions in the offshore environment during offloading operations, such as connection, LNG transfer and disconnection. As a specific example, each of the regasification LNGCs 410 and 412 may be a Qmax LNGC having two storage tanks that provide 265,000 cubic meters ($m^3$) of LNG storage, 1.0 billion standard cubic feet per day (bscf/d) regasification rate and a turret compartment.

To operate, the regasification LNGCs 410 and 412 may be configured to perform open sea cargo transfer (e.g. lightering) with the LNGCs 414*a*-414*n*. To begin, each of the LNGCs 414*a*-414*n* may follow the transit loop 418. Along the transit loop 418, each of the LNGCs 414*a*-414*n* receives LNG from an export terminal or other location and moves toward the import terminal 402, as discussed above. Concurrently, the first regasification LNGC 410 is attached to the first STL buoy 406, while it is regasifying LNG within its storage tanks, and delivering natural gas into the pipeline 404. As each of the LNGCs 414*a*-414*n* approaches the import terminal 402, a suitable lightering location is identified for each of the respective LNGCs 414*a*-414*n* along the transit loop 418 and one of the regasification LNGCs 410 and 412 along the lightering loop 416. For example, once the lightering location is selected, the second regasification LNGC 412 meets the LNGC 414*b* at the designated lightering location, and the lightering connection 420 is made between the regasification LNGC 412 and LNGC 414*b*. The LNG transfer may occur at speeds less than the LNGCs open sea speeds. Environmental conditions are monitored to ensure that the winds, waves, and currents remain favorable for the lightering operations. When LNG is transferred to the regasification LNGC 412, the LNGC 414*b* returns to an export terminal to receive additional LNG, while the regasification LNGC 412 returns to the import terminal 402, couples to the second STL buoy 408, regasifies the LNG into natural gas and offloads the natural gas into the pipeline 404. As the second regasification LNGC 412 begins offloading natural gas into the pipeline 404, the first regasification LNGC 410 may release from the first STL buoy 406 and may travel toward another designated lightering location to meet another one of the LNGCs 414*a*-414*n*. In this manner, the transfer process of the regasification LNGCs 410 and 412 and LNGCs 414*a*-414*n* continues to provide natural gas to the pipeline 404.

Beneficially, the lightering loop 416 (e.g. regasification LNGCs 410 and 412 movements between the lightering location with one of the LNGCs 414*a*-414*n* and one of the STL buoy 406 and 408) and transit loop 418 (e.g. LNGCs movements between the export terminal and the lightering location with one of the regasification LNGCs 410 and 412) continue to provide a continuous natural gas supply into the pipeline 404. As can be appreciated, the lightering loop 416 and transit loop 418 may not follow the same path each cycle, but may be adjusted based on various factors. For instance, the lightering location may be selected based on favorable environmental conditions (e.g. weather, seastates, storms, etc.). The flexibility to select the lightering location for the cargo transfer reduces the dependence on low wave heights for availability with typical LNG transfers at onshore or fixed offshore locations. As a result, if the seastates are too high for lightering operations in one location, another location in the open sea with more benign environmental conditions is selected. Another exemplary embodiment of a fluid transportation system is discussed in FIG. 5.

Figure 5:
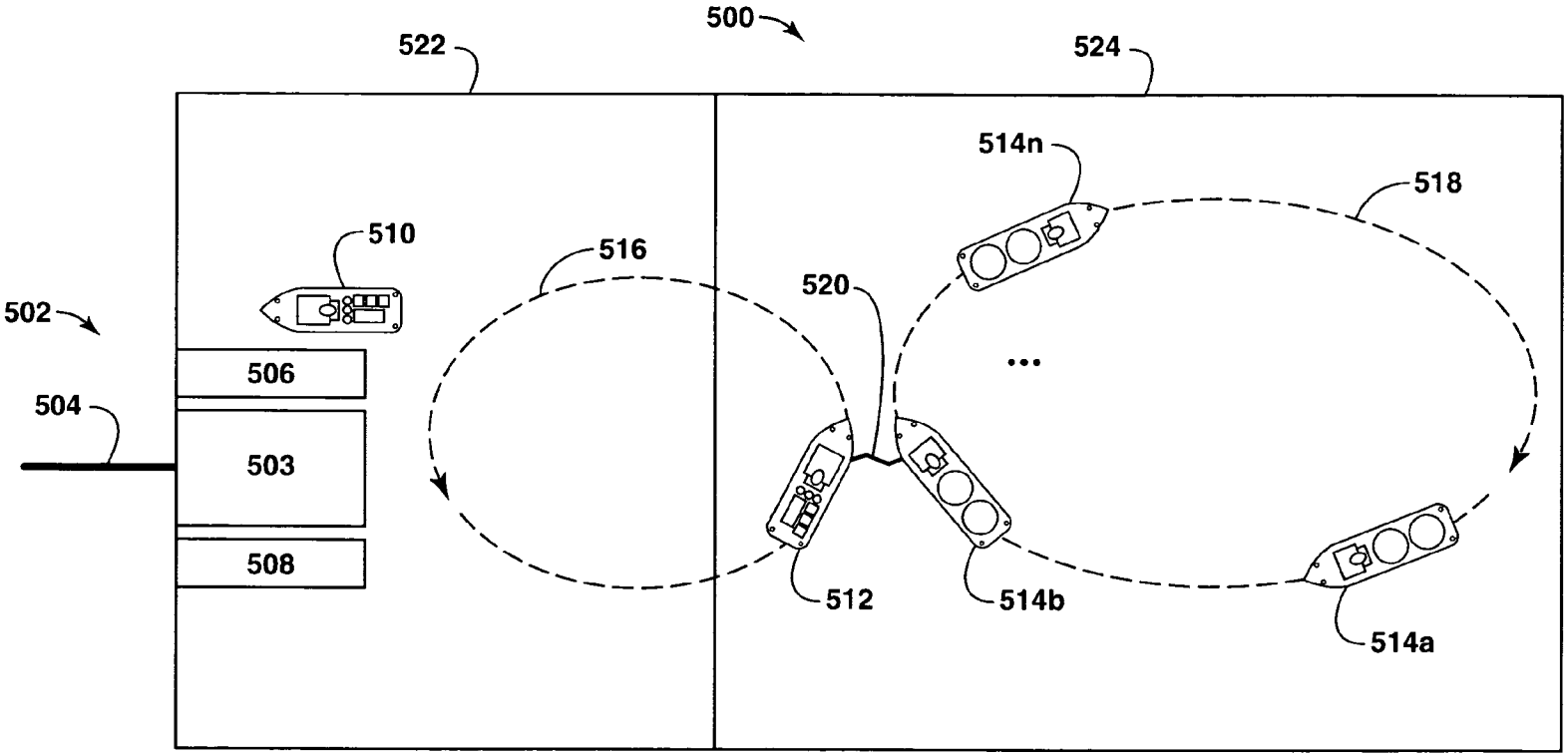
FIG. 5 is an illustration of a second exemplary fluid transport system or fleet in accordance with certain aspects of the present techniques.

FIG. 5 is an exemplary fluid transport system or fleet 500 in accordance with certain aspects of the present techniques. While this fluid transport system 500 may be similar to the fluid transport system 400, the fluid transport system 500 may be used for LNG exporting operations. Accordingly, in the exemplary fluid transport system 500, an export terminal 502 may be a land based LNG plant coupled to a pipeline 504 to receive hydrocarbons or produced fluids and provide LNG to one or more terminal vessels 510 and 512 and LNGCs 514*a*-514*n*. While the LNGCs 514*a*-514*n* may be similar to the LNGCs 414*a*-414*n* of FIG. 4, the terminal vessels 510 and 512 may be regasification LNGCs, which are similar to the regasification LNGCs 410 and 412 of FIG. 4, but are configured to function as ice breaker vessels or to have ice strengthened hulls in this embodiment. Further, the terminal vessels 510 and 512 may be ice breaker vessels having LNG storage or vessels having ice strengthened hulls and LNG storage in this embodiment, as well. Accordingly, the terminal vessels 510 and 512 may follow a lightering loop 516 through a body of water having ice packs 522 to provide LNG to the LNGCs 514*a*-514*n*, which follow a transit loop 518, at an open sea area 524 of the body of water. In this manner, the LNG from the export terminal 502 may be transferred to an import terminal (not shown) by terminal vessels 510 and 512 and LNGCs 514*a*-514*n*. Beneficially, the use of terminal vessels 510 and 512 may provide LNG from the export terminal despite the formation of ice packs 522, which may be present in high arctic locations with significant ice and icebergs.

The export terminal 502 may include various mechanisms to couple one or more terminal vessels 510 and 512. For instance, the export terminal 502 may include a loading platform 503 and one or more berthing structures, such as dolphins 506 and 508, which are each fixed to the sea floor or surface of the Earth. The transfer between the export terminal 502 and the terminal vessels 510 and 512 may use typical offloading equipment and offloading approaches, such as side-by-side offloading, tandem offloading, or SLTS offloading, as described above.

To transfer the LNG in this embodiment, the first terminal vessel 510 may be operatively coupled to the export terminal 502. Once the first terminal vessel 510 is loaded with LNG, it may traverse the ice pack 522 using ice breaking tugs or its own ice breaker equipment. Once the first terminal vessel 510 reaches an area free of pack ice (but not necessarily free of icebergs or ice formations), the first terminal vessel 510 moves to meet the LNGC 514*b* at a lightering location for transfer operations. The transfer between the first terminal vessel 510 and the LNGC 514*b* may be performed in a similar manner to the discussion above of the open sea transfers such as through lightering connection 520, which may be similar to lightering connection 420. Because the lightering location may be selected from any location in the open sea area 524, icebergs and other harsh environmental conditions (e.g. storms, severe seastates, currents, waves and the like) may be avoided for the LNG transfer. Then, the LNGC 514*b* may deliver the LNG to the import terminal (not shown), while the first terminal vessel 510 moves back to the export terminal 502 to receive more cargo.

Concurrently, the second terminal vessel 512 may receive LNG at the export terminal 502, while the first terminal vessel 510 is transferring the LNG to the LNGC 514*b*. As the first terminal vessel 510 returns to the export terminal 502, the second terminal vessel 512 departs the export terminal 502 to head through the ice pack 522 to a selected lightering location to transfer cargo to the next LNGC, which is another of the LNGCs 514*a*-514*n*. The LNGCs 514*a*-514*n* may provide the LNG to either an import terminal or other terminal vessels near the import terminal. Regardless, the terminal vessels 510 and 512 and the LNGCs 514*a*-514*n* may continue LNG transfers along the lightering loop 516 and the transit loop 518 to maintain the flow of cargo from the export terminal 502.

Beneficially, because the terminal vessels 510 and 512 are able to break through the ice packs to transport LNG continuously from the export terminal 502, the transit vessels, such as the LNGCs 514*a*-514*n*, do not have to travel through the ice packs 522 to receive LNG from the export terminal 502. That is, only the terminal vessels 510 and 512 have to be equipped with ice breaking capability, while the transit vessels can utilize conventional designs to reduced costs for the operations of exporting cargo from the export terminal 502. Further, with the lightering locations being any location in the open sea, the lightering locations may be selected to manage icebergs without expensive disconnectable or ice strengthened terminal designs. Also, as with the import terminal 402, the export terminal 502 may be scalable and provide continuous service with the use of more than one transit vessel and more than one export terminal, as is shown in greater detail in FIG. 6.

Figure 6:
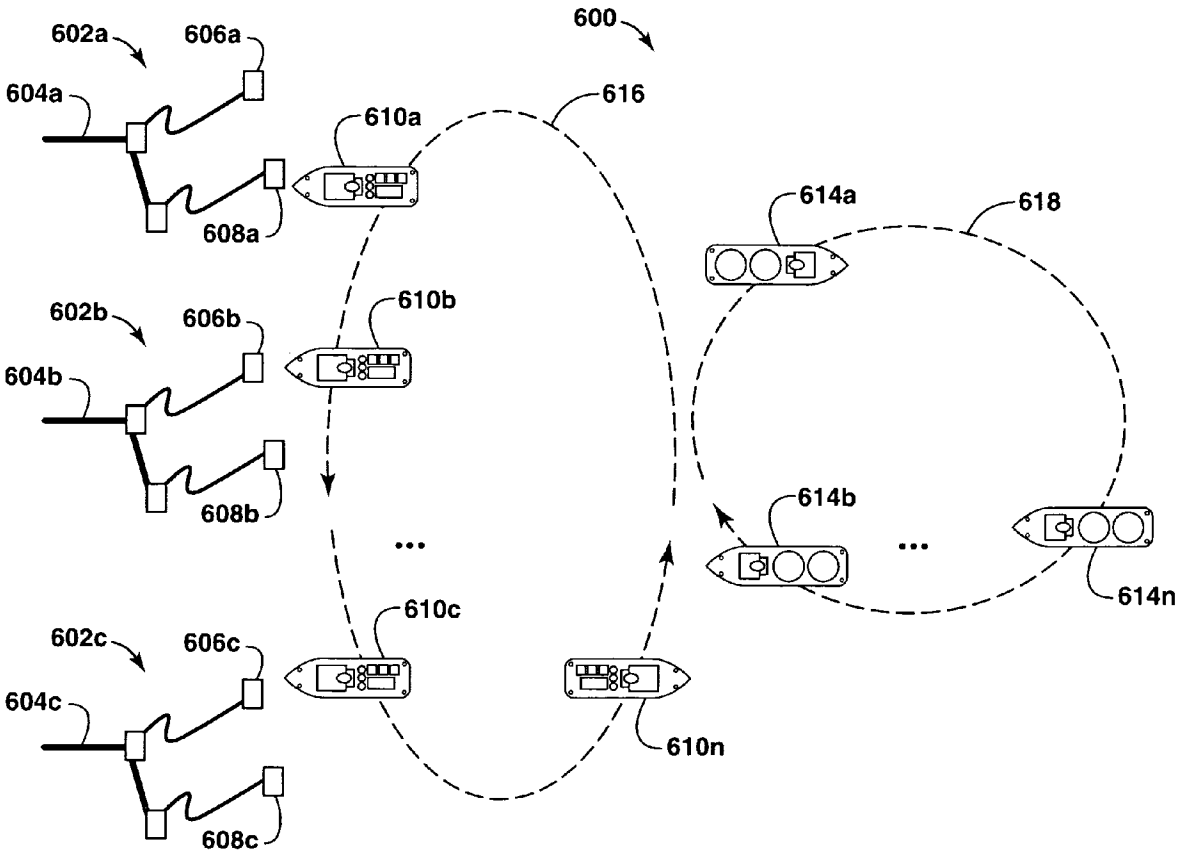
FIG. 6 is an illustration of a third exemplary fluid transport system or fleet in accordance with certain aspects of the present techniques.

FIG. 6 is an exemplary fluid transport system or fleet 600 in accordance with certain aspects of the present techniques. In the exemplary fluid transport system 600, multiple terminals 602*a*, 602*b* and 602*c* may be offshore import terminals similar to the import terminal 402, which have the one or more berthing structures, such as STL buoys 606*a*-606*c* and 608*a*-608*c*. For example, each terminal 602*a*-602*c* may include two or more STL buoys, depending on the specific design. The import terminals 602*a*-602*c* may each be coupled to a pipeline 604*a*-604*c* to receive natural gas or produced fluids from one or more regasification LNGCs 610*a*-610*n* and LNGCs 614*a*-614*n*, which are similar to the regasification LNGCs 410 and 412 and LNGCs 414*a*-414*n* of FIG. 4. In this configuration, the regasification LNGCs 610*a*-610*n* may receive LNG from one of the LNGCs 614*a*-614*n* and provide the LNG to any one of the import terminals 602*a*-602*c*. Then, the LNG from the LNGCs 614*a*-614*n* may be transferred to the respective pipeline 604*a*-604*c* through the associated import terminal 602*a*-602*c*. The selection of the import terminal 602*a*-602*c* may be based on operational conditions, such as environmental conditions and/or commercial conditions. As noted above, the operational conditions may include favorable environmental conditions (e.g. weather, seastates, storms, etc.) and commercial conditions (e.g. locations relative to best market, contractual obligations, highest demand, or offering the best price, etc.). It should be noted that the number of import terminals, LNGCs and regasification LNGCs may each be any integer number for different embodiments.

As an example of the operation, a first regasification LNGC 610*a* is coupled to the import terminal 602*a*. Once the regasification LNGC 610*a* is offloaded of LNG, it travels to a first lightering location to meet the LNGC 614*a* for transfer operations. Because the first lightering location may be selected from at any location in the open sea, the first lightering location may be selected based upon operational conditions, such as environmental conditions or commercial conditions (e.g. locations relative to best market, contractual obligations, etc.) for the LNG transfer. Then, the regasification LNGC 610*a* may return to one of the import terminals 602*a*-602*c* to deliver the LNG, while the LNGC 614*a* travels to another location, such as an export terminal (not shown) to receive another cargo load.

Concurrently with the operation of the first regasification LNGC 610*a*, a second regasification LNGC 610*b* may offload LNG at the import terminal 602*b*, while the first regasification LNGC 610*a* is transferring the LNG to the LNGC 614*a*. Also, a third regasification LNGC 610*c* may also offload LNG at the import terminal 602*c*, while the first regasification LNGC 610*a* is transferring the LNG to the LNGC 614*a*. As the first regasification LNGC 610*a* returns to one of the import terminals 602*a*-602*c*, the second regasification LNGC 610*b* departs the import terminal 602*b* to head to a second lightering location to receive LNG from the next LNGC, which may be LNGC 614*b*. The LNGC 614*b* may provide the LNG to the second regasification LNGC 610*b*. Regardless, the regasification LNGCs 610*a*-610*n* and the LNGCs 614*a*-614*n* may continue LNG transfers along the lightering loop 616 and the transit loop 618 to maintain the flow of cargo to the import terminals 602*a*-602*c*.

Beneficially, the present techniques are scalable with the installation of two or more import terminals 602*a*-602*c* and two or more regasification LNGCs 610*a*-610*n*. Because standard gas offloading buoys may be utilized, the regasification LNGCs 610*a*-610*n* may relocate between different gas buoys located at different import terminals 602*a*-602*c* in response to market forces and local gas prices. Further, the number of LNGCs 614*a*-614*n* in this process may be adjusted by LNG throughput and overall LNG delivery chain economics.

In other alternative embodiments, the terminals 402 or 502 may include one or more berthing structures for mooring the terminal vessels, such as regasification LNGCs 410 and 412 of FIG. 4 and terminal vessels 510 and 512 of FIG. 5, and for coupling the terminal vessels to a pipeline 404 or 504. For instance, berthing structures, such as dolphins, may be used to moor the terminal vessels adjacent a loading platform fixed to the sea bed. That is, the berthing structure of the import terminal may include mooring dolphins, which are structures fixed to the seafloor to secure mooring lines from the terminal vessels, and berthing dolphins, which are structures in contact with the terminal vessels to restrain its motion as well as also providing additional points for securing mooring lines. As another berthing structure for the terminals 402 and 502 may include the use of a spread mooring system. In a spread mooring system, multiple mooring lines may be used to restrict the heading of the terminal vessel. One end of the mooring lines is attached to one of the terminal vessels to be moored and the other end is attached to anchors or piles on the seafloor. The mooring lines are typically equipped with flotation devices when disconnected from the terminal vessels to facilitate their retrieval during mooring operations.

Furthermore, the terminal vessels associated with an export or import terminal may include different systems to compensate for certain conditions specific to a terminal in other embodiments. As an example, the terminal vessels 510 and 512 may be utilized with an import terminal instead of an export terminal. These terminal vessels may also include regasification facilities along with the LNG storage tanks to further enhance operations. As another example, the regasification LNGCs 410 and 412 may be utilized with an export terminal (not shown). In this manner, the LNGCs 410 and 412 may receive NG or LNG from the export terminal and provide LNG to the LNGCs 414*a*-414*n*. Further still, in another embodiment, the import terminal and the export terminal may have terminal vessels associated with the respective terminals. In this embodiment, the transit vessels transfer LNG with LNGCs via lightering operations at the import and export terminals without having to interact directly with the import or export terminal.

Moreover, in yet more embodiments, the above mentioned process and systems may be utilized to transport other cargos along with or instead of LNG. For instance, the cargo may be $CO_2$ or another liquefied gas. In these embodiments, the terminal vessels and transit vessels may include systems and equipment specific to the liquefied gas being transferred. While some of the equipment may be similar to the equipment discussed above, other equipment may include pressure vessels and other equipment that are designed to maintain and contain specific pressures for the cargo.

Figure 7A:
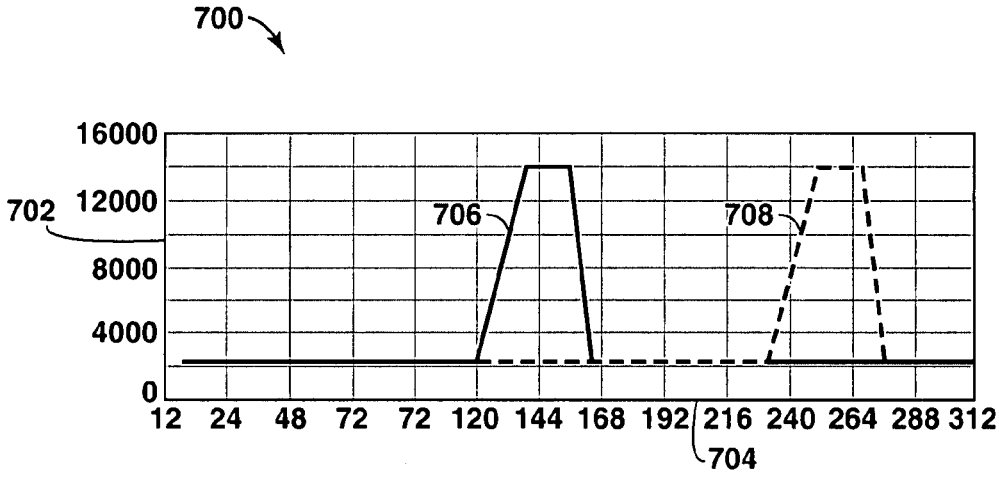
FIGS. 7A and 7B are exemplary charts of LNG transfer rates in cubic meters pr hour ($m^3$/hr) shown against hours.
Figure 7B:
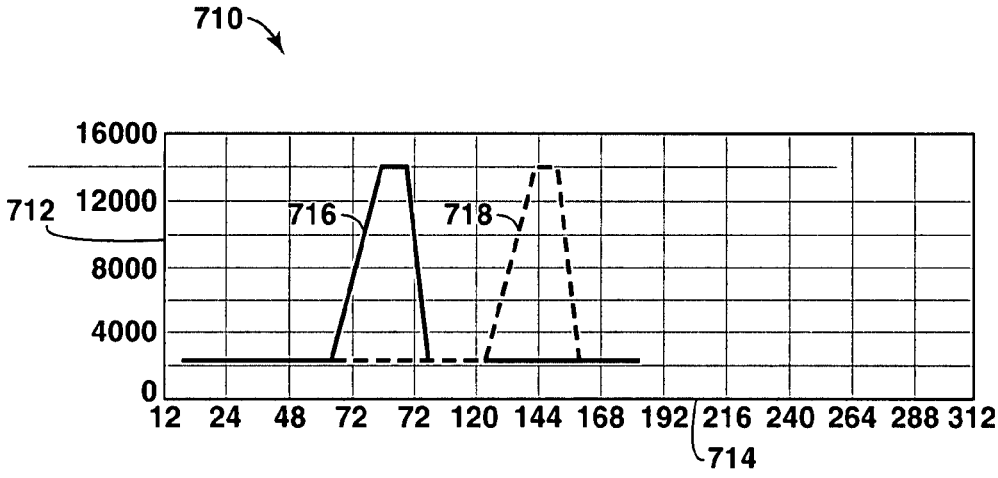

Furthermore, as noted above a determination may be made regarding the lightering location, which may be based on the range of distances within the lightering loop. This determination may include calculating the speed of the terminal vessels along with the speed of the transfer operations. For example, as shown in FIGS. 7A and 7B, different charts 700 and 710 of LNG transfer rates in cubic meters per hour (m3/hr) are shown against hours. In these charts 700 and 710, different terminal vessels are utilized to determine the range of these vessels, which does not interrupt the flow of fluids into the terminal.

For instance, in FIG. 7A, the chart 700 shows the LNG transfer operations for two terminal vessels with the transfer rates in cubic meters per hour ($m^3$/hr) along a transfer axis 702 against hours along the time axis 704. In this chart 700, the sendout rate to gas pipeline at the terminal is about 2,319 cubic meters per hour ($m^3$/hr), and the lightering transfer rate is about 14,000 $m^3$/hr. The lightering transfer rate is similar to SLTS transfer rates in subsea cryogenic transfer applications. Also, the terminal vessels may have a Q-Max parcel size (e.g.

holds between 245,000 $m^3$ to 263,000 $m^3$) and transfer at 1.2 GCFD sendout. These terminal vessels may also move 100 nautical miles (nms) at 15 knots (kts) and transfer fluids with a transit vessel while moving at about 10 kts. As shown in this chart 700, the first terminal vessel may perform various operations as shown along first response 706 and the second terminal vessel may perform various operations as shown along a second response 708. In particular, the first terminal vessel may transfer regasified fluid with the pipeline from the 9 hour to the 120 hour, while the second terminal vessel may transfer regasified fluid with the pipeline from about 121 hour to about 232 hour. These transfer operations may then be alternated for further time periods. Once the second vessel is transferring regasified fluid (e.g. from the 121 hour to the 232 hour), the first terminal vessel may move to a transfer location 100 nms from the terminal, transfer LNG from the transit vessel, and move back to the terminal. As a result, to ensure a continuous supply of fluid, about 66 hour margin exists (e.g. from the 166 hour to the 232 hour) for the terminal vessels associated with the buoys of the terminal.

In FIG. 7B, the chart 710 shows the LNG transfer rates in cubic meters per hour ($m^3$/hr) along a transfer axis 712 against hours along the time axis 714. In this chart 710, the sendout rate to gas pipeline at the terminal is again about 2,319 cubic meters per hour ($m^3$/hr), and the lightering transfer rate is about 14,000 $m^3$/hr. However, in this example, the terminal vessels may have a conventional LNG (CLNG) parcel size (e.g. hold 138,000 $m^3$) and transfer at 1.2 GCFD sendout. These terminal vessels may also move 100 nautical miles (nms) at 15 knots (kts) and transfer fluids with a transit vessel while moving at about 10 kts. As shown in this chart 710, the first terminal vessel may perform various operations as shown along first response 716 and the second terminal vessel may perform various operations as shown along a second response 718. The first terminal vessel may transfer regasified fluid with the pipeline from the 9 hour to the 67 hour, and the second terminal vessel may transfer regasified fluid with the pipeline from about 68 hour to about 126 hour. These transfer operations may then be alternated for further time periods. Once the second vessel is transferring regasified fluid (e.g. from the 68 hour to the 126 hour), the first terminal vessel may move to a transfer location 100 nms from the terminal, transfer LNG from the transit vessel, and move back to the terminal. As a result, to ensure a continuous supply of fluid, about a 22 hour margin (e.g. from the 104 hour to the 126 hour) exists for the terminal vessels associated with the buoys of the terminal.

As may be appreciated, from the examples above, different sized lightering loops may also be considered. Again, these lightering loops (e.g. range of the terminal vessels) are based on the speed of the terminal vessels and the transfer rate of the fluid (e.g. cryogenic fluid or regasified fluid) between the terminal vessel and the terminal or transit vessel.

Also, the determination of the lightering loop may also be adjusted based on the number of terminal vessels supporting one terminal or a group of terminals. For instance, as discussed in FIG. 6, multiple terminal vessels may support multiple terminals. As a result, the determination of lightering locations may be based on the terminals and terminal vessels being utilized in one system.

Moreover, the present techniques may be used for other embodiments where the terminal vessels have specialized equipment. For example, the terminal vessels in any of the embodiments of FIGS. 4-6 may include terminal vessels fitted with other terminal specific equipment to enable safe navigation between the terminal and the open sea location for cargo transfer with the transit vessel. This terminal specific equipment may include navigation equipment (e.g. azimuthing thrusters). Further, the terminal specific equipment may include berthing and mooring equipment (e.g. fittings for compatibility with different terminals.) For example, if the terminal is a floating forklift type facility or utilizing booms, special mooring equipment or structural aspects of the terminal vessel may be utilized to secure the vessel to the terminal. Also, the terminal specific equipment may include specific cargo transfer equipment, such as loading arms, pumps, cryogenic hoses, telescoping booms, etc.

While the present techniques of the invention may be susceptible to various modifications and alternative forms, the exemplary embodiments discussed above have been shown only by way of example. However, it should again be understood that the invention is not intended to be limited to the particular embodiments disclosed herein. Indeed, the present techniques of the invention include all alternatives, modifications, and equivalents falling within the true spirit and scope of the invention as defined by the following appended claims.

What is claimed is:

1. A method for transporting cryogenic fluid comprising:

coupling a transit vessel to a terminal vessel at an open sea location;

transferring cryogenic fluid between the transit vessel and the terminal vessel, wherein the cryogenic fluid is transferred while the transit vessel and terminal vessel are moving in substantially the same direction;

decoupling the terminal vessel from the transit vessel;

moving the terminal vessel to a terminal to transfer the one of the cryogenic fluid and a gas formed from the cryogenic fluid between the terminal vessel and the terminal; and determining the open sea location based on a transfer rate of the cryogenic fluid between the terminal vessel and the transit vessel, a transfer rate of the gas formed from the cyrogenic fluid between the terminal vessel and the terminal, or a combination thereof.

2. The method of claim 1 wherein the cryogenic fluid is liquefied natural gas (LNG).

3. The method of claim 2 further comprising regasifying the LNG on the terminal vessel and delivering the regasified LNG to a pipeline coupled to the terminal.

4. The method of claim 2 further comprising delivering the LNG to the terminal and vaporizing the LNG at the terminal for delivery of the vaporized LNG to a pipeline coupled to the terminal.

5. The method of claim 2 further comprising receiving natural gas from a pipeline at the terminal and liquefying the natural gas to form LNG on the terminal vessel.

6. The method of claim 2 further comprising receiving LNG from the terminal.

7. The method of claim 1 wherein transferring cryogenic fluid between the transit vessel and the terminal vessel comprises one of side-by-side offloading and tandem offloading.

8. The method of claim 1 wherein the terminal vessel comprises storage tanks and regasification equipment.

9. The method of claim 1 wherein moving the terminal vessel to the terminal comprises moving the terminal vessel through ice packs to reach the terminal.

10. The method of claim 1 wherein the terminal vessel is one of an ice breaker carrier, an ice strengthened carrier, a carrier having azimuthing thrusters, and any combination thereof.

11. The method of claim 1 further comprising:

coupling another terminal vessel to the terminal; and transferring additional cryogenic fluid between the another terminal vessel and the terminal concurrently with transferring the cryogenic fluid between the transit vessel and the terminal vessel.

12. The method of claim 11 wherein coupling the another terminal vessel to the terminal comprises securing the another terminal vessel to one of two buoys at the terminal.

13. The method of claim 1 further comprising selecting the open sea location based upon at least one environmental condition.

14. The method of claim 13 wherein the at least one environmental condition comprise one of weather, seastates, and any combination thereof.

15. The method of claim 1 wherein the cryogenic fluid is liquefied carbon dioxide ($CO_2$).

16. The method of claim 1 further comprising determining the open sea location based on the speed of the terminal vessel.

17. A method for transporting fluid comprising:

coupling a transit vessel to a terminal vessel at an open sea location, wherein the terminal vessel is one of an ice breaker carrier or an ice strengthened carrier;

transferring fluid between the transit vessel and the terminal vessel, wherein the fluid is transferred while the transit vessel and the terminal vessel are moving in substantially the same direction;

decoupling the terminal vessel from the transit vessel;

moving the terminal vessel through ice packs to reach a terminal to transfer the one of the fluid and a gas formed from the fluid between the terminal vessel and the terminal; and determining the open sea location based on a transfer rate of the fluid between the terminal vessel and the transit vessel, a transfer rate of the gas formed from the fluid between the terminal vessel and the terminal, or a combination thereof.

18. The method of claim 17 wherein the fluid is liquefied natural gas (LNG).

19. The method of claim 18 further comprising regasifying the LNG on the terminal vessel and delivering the regasified LNG to a pipeline coupled to the terminal.

20. The method of claim 18 further comprising delivering the LNG to the terminal and vaporizing the LNG at the terminal for delivery of the vaporized LNG to a pipeline coupled to the terminal.

21. The method of claim 18 further comprising receiving natural gas from a pipeline at the terminal and liquefying the natural gas to form LNG on the terminal vessel.

22. The method of claim 18 further comprising receiving LNG from the terminal.

23. The method of claim 17 wherein transferring fluid between the transit vessel and the terminal vessel comprises one of side-by-side offloading and tandem offloading.

24. The method of claim 17 wherein the terminal vessel comprises storage tanks and regasification equipment.

25. The method of claim 17 further comprising:

coupling another terminal vessel to the terminal; and transferring additional fluid between the another terminal vessel and the terminal concurrently with transferring the fluid between the transit vessel and the terminal vessel.

26. The method of claim 25 wherein coupling the another terminal vessel to the terminal comprises securing the another terminal vessel to one of two or more buoys at the terminal.

27. The method of claim 17 further comprising selecting the open sea location based upon at least one environmental condition.

28. The method of claim 27 wherein the at least one environmental condition comprise one of weather, seastates, and any combination thereof.

29. The method of claim 17 wherein the fluid is liquefied carbon dioxide ($CO_2$).

30. The method of claim 17 further comprising determining the open sea location based on the speed of the terminal vessel.

* * * * *

US008448673C1

(12) EX PARTE REEXAMINATION CERTIFICATE (10197th)

United States Patent
Danaczko et al.

(10) Number: US 8,448,673 C1
(45) Certificate Issued: Jun. 24, 2014

(54) TRANSPORTING AND TRANSFERRING FLUID

(75) Inventors: Mark A. Danaczko, Houston, TX (US); Mark C. Gentry, The Woodlands, TX (US); Robert E. Sandstrom, Sugar Land, TX (US)

(73) Assignee: ExxonMobil Upstream Research Company, Houston, TX (US)

Reexamination Request:
No. 90/013,057, Nov. 13, 2013

Reexamination Certificate for:

| | |
|---|---|
| Patent No.: | **8,448,673** |
| Issued: | **May 28, 2013** |
| Appl. No.: | **12/447,635** |
| Filed: | **Jan. 15, 2010** |

(21) Appl. No.: 90/013,057

(22) PCT Filed: Sep. 17, 2007

(86) PCT No.: PCT/US2007/020107

§ 371 (c)(1), (2), (4) Date: Jan. 15, 2010

(87) PCT Pub. No.: WO2008/060350

PCT Pub. Date: May 22, 2008

Related U.S. Application Data

(60) Provisional application No. 60/859,266, filed on Nov. 15, 2006.

(51) Int. Cl.
*B65B 3/04* (2006.01)
*B63B 27/30* (2006.01)

(52) U.S. Cl.
USPC ..... 141/1; 141/11; 62/606; 62/50.2; 62/53.2; 137/899.2; 441/4

(58) Field of Classification Search
None
See application file for complete search history.

(56) References Cited

To view the complete listing of prior art documents cited during the proceeding for Reexamination Control Number 90/013,057, please refer to the USPTO's public Patent Application Information Retrieval (PAIR) system under the Display References tab.

*Primary Examiner* — Beverly M. Flanagan

(57) ABSTRACT

A method and system for transporting fluid is described. The method includes coupling a transit vessel to a terminal vessel associated with at least one terminal. The transit vessel and the terminal vessel are coupled at an open sea or lightering location, which may be selected based upon operational conditions. Then, cryogenic fluid is transferred between the transit vessel and the terminal vessel, while the transit vessel and terminal vessel are moving in substantially the same direction. Once the transfer is complete, the terminal vessel decouples from the transit vessel and moves a terminal to provide the cryogenic fluid to the terminal. The cryogenic fluid may include liquefied natural gas (LNG) and/or liquefied carbon dioxide ($CO_2$).

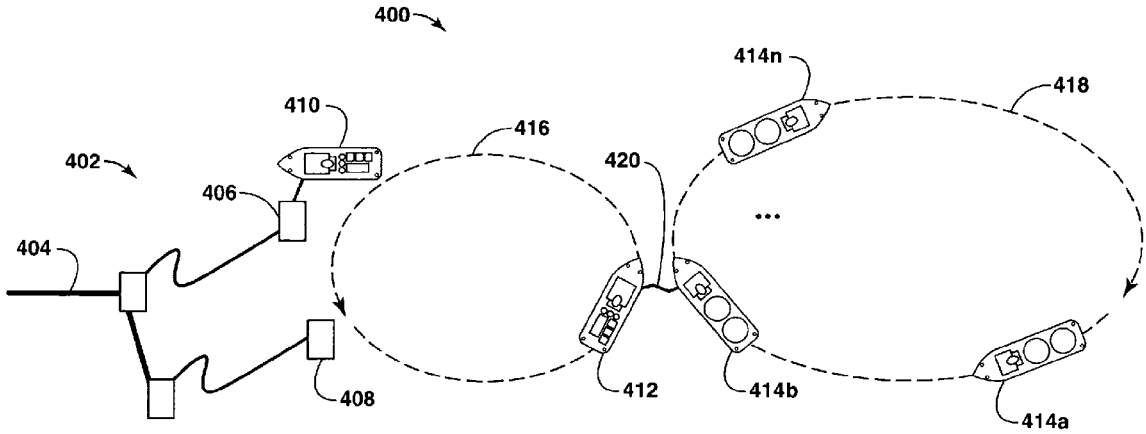

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-30 is confirmed.

* * * * *